US008192268B1

(12) United States Patent
Karpe

(10) Patent No.: US 8,192,268 B1
(45) Date of Patent: Jun. 5, 2012

(54) INSTANT LOTTERY TICKET VENDING MACHINE WITH TICKET REVEAL AND SCAN FOR COMPUTER GENERATED DISPLAY OF RESULTS

(76) Inventor: Craig Robert Karpe, Avon, IN (US)

( * ) Notice: Subject to any disclaimer, the term of this patent is extended or adjusted under 35 U.S.C. 154(b) by 930 days.

(21) Appl. No.: 12/082,848

(22) Filed: Apr. 15, 2008

Related U.S. Application Data

(60) Provisional application No. 60/923,406, filed on Apr. 16, 2007.

(51) Int. Cl.
*A63F 9/24* (2006.01)

(52) U.S. Cl. ..... 463/17; 463/16; 463/20; 463/30

(58) Field of Classification Search ..... 463/16, 463/17, 20, 30
See application file for complete search history.

(56) References Cited

U.S. PATENT DOCUMENTS

| | | | | |
|---|---|---|---|---|
| 2,248,191 | A * | 7/1941 | Pratt | 451/301 |
| 2,936,551 | A * | 5/1960 | Rich et al. | 451/41 |
| 3,580,121 | A * | 5/1971 | Asada et al. | 83/107 |
| 4,765,842 | A | 8/1988 | Sanders et al. | |
| 4,842,278 | A | 6/1989 | Markowicz | |
| 5,042,809 | A * | 8/1991 | Richardson | 463/18 |
| 5,222,624 | A | 6/1993 | Burr | |
| 5,253,383 | A | 10/1993 | Clark | |
| 5,348,299 | A * | 9/1994 | Clapper, Jr. | 463/16 |
| 5,355,543 | A | 10/1994 | Cameron et al. | |
| 5,402,549 | A | 4/1995 | Forrest | |
| 5,810,664 | A * | 9/1998 | Clapper, Jr. | 463/17 |
| 5,907,882 | A | 6/1999 | Tyree | |
| 5,928,082 | A * | 7/1999 | Clapper, Jr. | 463/16 |
| 5,979,011 | A * | 11/1999 | Miyawaki et al. | 15/308 |
| 5,980,385 | A | 11/1999 | Clapper, Jr. | |
| 6,024,640 | A | 2/2000 | Walker | |
| 6,056,289 | A * | 5/2000 | Clapper, Jr. | 273/138.2 |
| 6,135,335 | A * | 10/2000 | Shoemaker, Jr. | 226/39 |
| 6,161,743 | A * | 12/2000 | Shoemaker, Jr. | 226/183 |
| 6,656,042 | B2 | 12/2003 | Reiss et al. | |
| 6,726,077 | B2 | 4/2004 | Robert et al. | |
| 6,733,385 | B1 | 5/2004 | Enzminger et al. | |
| 6,886,728 | B2 | 5/2005 | Roberts et al. | |
| 6,932,258 | B1 * | 8/2005 | Roberts et al. | 225/103 |
| 6,991,541 | B2 | 1/2006 | Lind et al. | |
| 7,047,104 | B2 | 5/2006 | Perin, Jr. et al. | |
| 7,163,459 | B2 | 1/2007 | Tanskanen | |

(Continued)

FOREIGN PATENT DOCUMENTS

JP 06-035943 2/1994

(Continued)

*Primary Examiner* — Peter DungBa Vo
*Assistant Examiner* — Nicholas Ditoro
(74) *Attorney, Agent, or Firm* — E. Victor Indiano; Indiano Law Group LLC

(57) ABSTRACT

A gaming ticket dispensing device is provided for dispensing tickets having prize-revealing characters and a removable covering for hiding the prize-revealing characters prior to acquisition by an end user. The ticket dispensing device includes a storage mechanism for holding a plurality of gaming tickets. A revealer is provided for removing the removable covering to reveal the prize-revealing characters, and a scanner is provided for scanning the prize-revealing characters. A processor is in communication with the scanner for processing the scanned characters' information to determine a prize value associated with the characters scanned. An audio visual display displays an audio visual message relating to the prize value and a dispensing port is provided for dispensing the gaming ticket to the user.

18 Claims, 8 Drawing Sheets

U.S. PATENT DOCUMENTS

| | | | |
|---|---|---|---|
| 7,179,168 | B1 | 2/2007 | Tulley et al. |
| 7,186,180 | B2 | 3/2007 | Lathrop et al. |
| 7,192,348 | B2 | 3/2007 | Brosnan et al. |
| 7,203,361 | B1 | 4/2007 | Meier |
| 7,203,383 | B2 | 4/2007 | Fisher |
| 2001/0034263 | A1 | 10/2001 | Roberts |
| 2003/0130042 | A1 | 7/2003 | Ollins |
| 2003/0236749 | A1 | 12/2003 | Shergalis |
| 2004/0014514 | A1 | 1/2004 | Yacenda |
| 2004/0023711 | A1 | 2/2004 | Knapp |
| 2004/0162131 | A1* | 8/2004 | Shuster ..... 463/17 |
| 2005/0064925 | A1 | 3/2005 | Robb |
| 2005/0107148 | A1 | 5/2005 | Webb |
| 2006/0258433 | A1 | 11/2006 | Finocchio et al. |
| 2007/0099689 | A1 | 5/2007 | Penrice |
| 2007/0129144 | A1 | 6/2007 | Katz et al. |

FOREIGN PATENT DOCUMENTS

| | | |
|---|---|---|
| JP | 07-239959 | 9/1995 |
| WO | WO 2005/013213 A1 | 2/2005 |

* cited by examiner

INSTANT LOTTERY TICKET VENDING MACHINE WITH TICKET REVEAL AND SCAN FOR COMPUTER GENERATED DISPLAY OF RESULTS

I. REFERENCE TO RELATED APPLICATIONS

This Application claims the benefit of U.S. Provisional Application No. 60/923,406, filed on 16 Apr. 2007, which is incorporated herein by reference in its entirety.

II. TECHNICAL FIELD OF THE INVENTION

This invention relates to gambling devices, and more particularly to lottery scratch-off and pull-tab ticket vending machines, as well as casino video games and devices that simulate casino video games, and character recognition software.

III. BACKGROUND OF THE INVENTION

Lotteries have been adopted by many state governments as a means of generating additional tax revenue for projects such as highway construction, new schools, and public works programs. As state lotteries have proliferated, lotteries have employed a series of scratch-off and pull-tab games that closely resemble casino style gaming machines in their play.

Commonly, lotteries issue instant win game tickets containing characters indicating whether a prize has been won. The characters are obscured so that they are not readily visible to persons prior to their purchase of the ticket. Typically, the characters are obscured by either (1) paper "pull-tabs" secured by perforated edges which must be torn or burst; or (2) a waxy or plastic covering that is applied over the characters, and which must be removed by scratching with a coin or similar object. The purchaser "plays" the lottery ticket by purchasing it, and removing the covering to reveal the characters showing whether the card is a winner. If the card contains a winning combination of characters, the player may redeem it for the prize designated.

While a number of varied scratch-off and pull-tab lottery games are offered, the games can be reduced to six basic sub-types:

(1) "WAR": In War-type games, the player is given a series of player numbers or "cards" which must be of a higher value than corresponding key numbers or cards to win;

(2) "BLACKJACK": Blackjack games are similar to War-type games, except that the set of player numbers or player "card hands" (usually five) corresponds to only one key card hand or number. The object of "Blackjack" type games is to get the highest value without exceeding a specified limit (usually 21).

(3) "MATCH": In Match type games, one or more key characters or numbers is provided. In order to win, the player must match the key with one or more of his set of player characters or numbers.

(4) "MATCH 3": Match 3 is similar in concept to the manner in which a classic slot machine operates. In Match 3 type games, a player is given one or more series of three character sets. If the three characters in any set match, the player wins.

(5) "TEXAS HOLD 'EM": Texas Hold 'Em is a simulation of the poker game, wherein the player is given two cards, the house is given two cards, and there is a five card flop which both player and house can include to create the best poker hand.

(6) "BINGO": In Bingo type games, a set of key characters are provided as well as a series of "bingo cards." The ticket is a winner if the key characters appear on the bingo card in the proper formation.

Variations are introduced to add novelty to instant ticket games and to better hold the interest of potential ticket purchasers. However, these variations also add to the complexity to the games. Typical variations include changes in the number of key characters or player characters, the inclusion of wild characters, and the addition of bonus characters which (1) add prizes; (2) multiply winnings; or (3) add chances to win.

From a competitive standpoint, the instant ticket suffers from a number of drawbacks. These drawbacks can be appreciated by comparing lottery instant win tickets to their main legal competition, regional casino facilities. Casinos offer similar games, but in a much easier to use system. Either an attendant or machine tells the player how to play and whether they have won. The player is not required to read fine print and figure out rules. Additionally, casino games allow a more fast-paced game play than instant lottery tickets. Moreover, casino machines include lights, computer graphics, and sound to stimulate player interest, something not possible with a lottery ticket.

A number of vending machines for selling instant lottery tickets have been patented. Most of these machines operate similarly to existing non-gambling vending machines, as their primary two functions are to collect money and to dispense a purchased item, which in the case of a lottery ticket machine is a lottery ticket. Typically, the purchaser inserts money and pushes buttons on the machine to indicate the type of ticket and number of tickets desired. The machine then vends the tickets, and the purchaser receives whatever change is appropriate. Patents disclosing this type of vending machine include U.S. Pat. Nos. 5,222,624, and 6,886,728.

Patents have also been issued for devices to remove the waxy material from scratch-off tickets. Such patents include U.S. Pat. Nos. 4,765,842, 5,253,383, 5,355,543, 5,402,549, 5,907,882. These devices are adequate as an alternative to manual removal of the scratch-off material, but are not believed to be fast enough or thorough enough to allow the high-speed scanning and vending of tickets required for operation in connection with the device of the present invention.

Additionally, patents have also been issued for devices that simulate slot machine play from information supplied by a central computer server (see, for example, U.S. Pat. Nos. 6,733,385, 6,991,541, 7,192,348) or a computer barcode printed on a ticket (see. e.g. U.S. Pat. No. 5,980,385). One significant difference between the present invention and the known art is that in the preferred embodiment, the present invention reveals and utilizes the actual human readable characters contained on the ticket, rather than relying on the additional introduction of computer readable code.

Many patents have been issued for scanning devices and optical character recognition programs that convert printed text into a computer graphic display. See, for example, U.S. Pat. Nos. 7,203,663, 7,203,383, and 7,203,361 for recent patents in this area.

To Applicant's knowledge, no device currently exists that will remove the concealing material from a lottery ticket, pass the ticket through an optical scanning device, read the characters contained thereon, vend the ticket, and display the results by means of computer generated audiovisual display. It is therefore an object of a preferred embodiment of the present invention to provide such a device.

It is the hope that the present invention will bridge the gap between paper-based gambling methods such as pull-tabs and scratch off tickets, and computer based video gaming devices. It is believed that the device would have the benefit of adding the excitement of an actual video game machine to the sale and distribution of instant tickets.

IV. SUMMARY OF THE INVENTION

In accordance with the present invention, a gaming ticket dispensing device is provided for dispensing tickets having prize-revealing characters and a removable covering for hiding the prize-revealing characters prior to acquisition by an end user. The ticket dispensing device comprises a storage mechanism for holding a plurality of gaming tickets, and a revealer for removing the removable covering to reveal the prize-revealing characters. A scanner is provided for scanning the prize-revealing characters, and a processor in communication with the scanner is provided for processing the scanned characters' information to determine a prize value associated with the characters scanned. An audio visual display is provided for displaying an audio visual message relating to the prize value, and a dispensing port is provided for dispensing the game ticket to the end user.

Preferably, the device also includes a transport mechanism such as a transporter for transporting the gaming tickets between the storage mechanism, the revealer, the scanner and the dispensing port. This transporting mechanism can comprise a device to feed tickets directly from storage mechanism into the revealer, from the revealer to the scanner, and to gravity feed the tickets to the dispensing port. The transporting mechanism should be designed to minimize ticket processing time. Optimally, a preferred embodiment of the device can be designed to contain a storage mechanism that is capable of storing gaming tickets either as a roll of joined gaming tickets, or as a stack of tickets. Additionally, a preferred embodiment of the present invention can include a revealer that is capable of removing either or both of a scratch off-type covering of a scratch off-type ticket, or a material sheet covering of a "pull-tab" type ticket.

One feature of the preferred embodiment of the present invention is that the device of the present invention is capable of vending, and operating with both scratch-off and pull-tab type lottery tickets, along with being able to reveal the prize of the tickets prior to dispensing the ticket, or alternately, dispensing the ticket without revealing the prize. When the end user selects to reveal the prize, the prize-revealing characters contained on the ticket that are revealed by the revealer can be optically scanned, and understood by a central processing unit within the device. Once the prize is understood by the processing unit, the prize result (if any) can be displayed on a graphic display, that may be accompanied by audio signals.

In a most preferred embodiment of the present invention, these audio signals and graphic displays are similar to the audio signals and graphic displays that are typically associated with electronic gaming machines (such as slot machines, video poker, video blackjack, video roulette, video craps, and video slot machines), and that are believed to stimulate player interests. The combination of the ticket's value being revealed, along with the audio and visual displays, helps to incorporate fast pace, sound, light and computer graphics into the ticket buying experience, to provide a casino-like gambling machine, that nevertheless operates with non-casino type games such as lottery tickets.

The present invention has the potential to bring a casino-like experience to non-casino locations. It is believed that this casino-like experience will help to stimulate the sale of tickets, thus benefiting the lottery organizer (typically a state government), along with the ticket seller (typically a store, bar, etc.).

An additional feature of the present invention is that the device is capable of assisting a player in determining whether a purchased ticket is a winning ticket and has the funds handling capabilities to enable the machine to accept coins and currencies, and to allow the player to make repeated purchases of tickets, until the player decides to "cash out", or to request change.

Another feature of the preferred embodiment of the present invention is that it is well adapted to operate with a wide variety of currently existing game types, including war type games, blackjack type games, match type games, match 3 type games, Texas-hold-em type games and the like. This wide variety of possible game types helps to make the machine more valuable, by making it workable with a wider variety of games, thus reducing the limitations on a game that might be imposed on the game creator.

Another feature of the present invention is that it includes a storage device that can be designed to accommodate a plurality of tickets. These tickets can be placed in the storage device either as a roll, or as a stack. Further, the present invention can also accommodate either or both scratch off type tickets and pull tab type tickets.

A further feature of the present invention is that it includes a computer that is easily programmable. This easy programmability of the computer will enable the user to upload new information (as necessary) both to improve the performance of the device, and also to accommodate different types of games, different types of tickets, and different types of prize situations.

Another feature of the present invention is that it can be designed to be placed within and fit within machine cabinets and housing of different sizes. For example, the device can be designed to fit into a standard size slot machine cabinet. By placing it in a slot machine sized cabinet, the size of the machine would draw an association between the user and the intended purpose of the machine, to thereby help to stimulate sales. Alternately, the device can be designed to be placed in a smaller, table top container, so that it can be used in situations where table tops are available, such as in bars, and restaurants. As another alternative, the device of the present invention can be configured for placement in a soft-drink machine-sized cabinet. The placement of the machine in a larger, soft drink machine-sized cabinet that is approximately the size of a full-sized 26 cubic foot refrigerator would have the primary effect of enabling the device to maintain a larger amount of inventory, thus enabling the device to accommodate a very wide variety of games, or else to contain a large enough inventory of gaming tickets to go for long periods of time before needing to be refilled, or else, to provide sufficient inventory for contained operation for a substantial period of time in high volume ticket sales situations.

These and other features of the present invention will become apparent to those skilled in the art upon a review of the best mode of practicing the invention perceived presently by the Applicant, that is described in more detail below in the Drawings and Detailed Description of Preferred Embodiment.

V. DRAWINGS

Figure 8D:
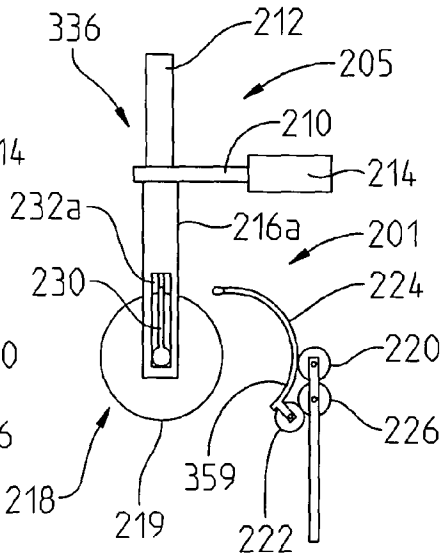
Figure 8C:
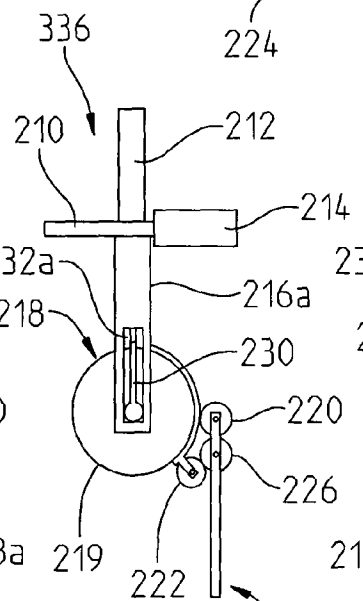
Figure 8B:
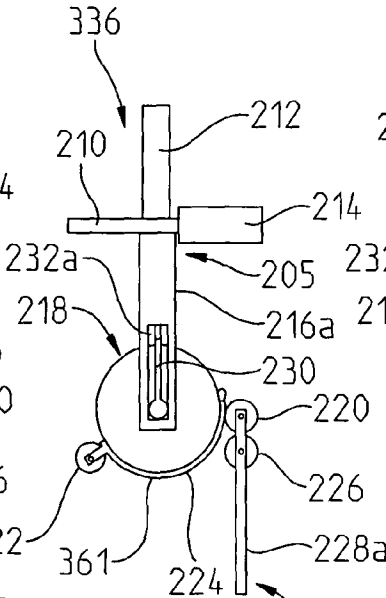
Figure 8A:
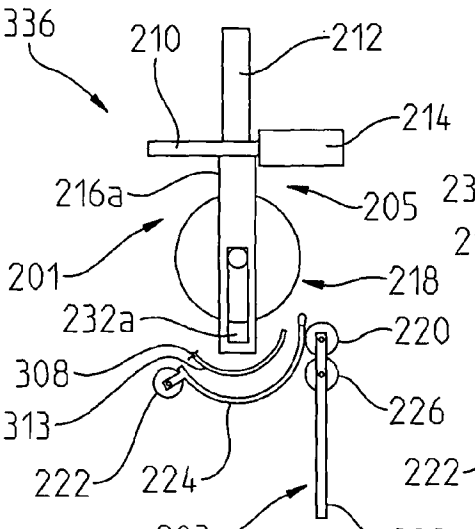
Figure 8E:
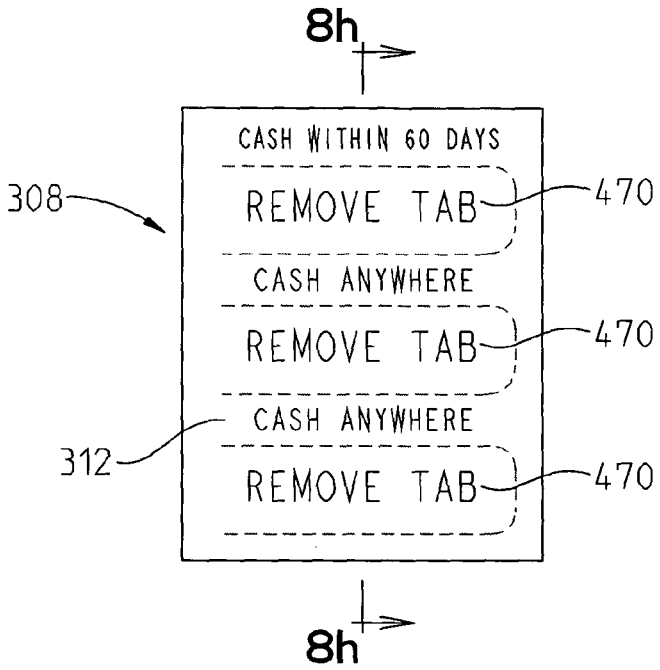
Figure 8F:
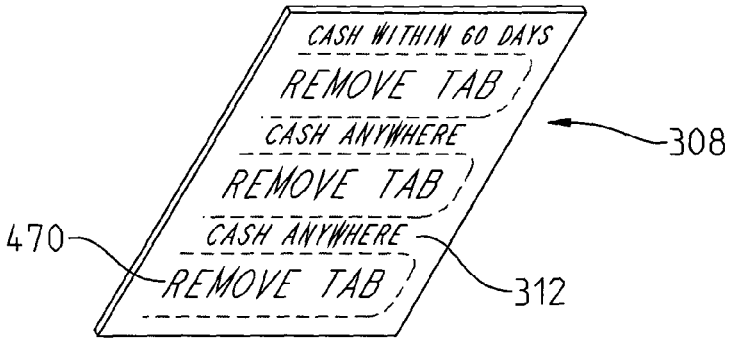
Figure 9:
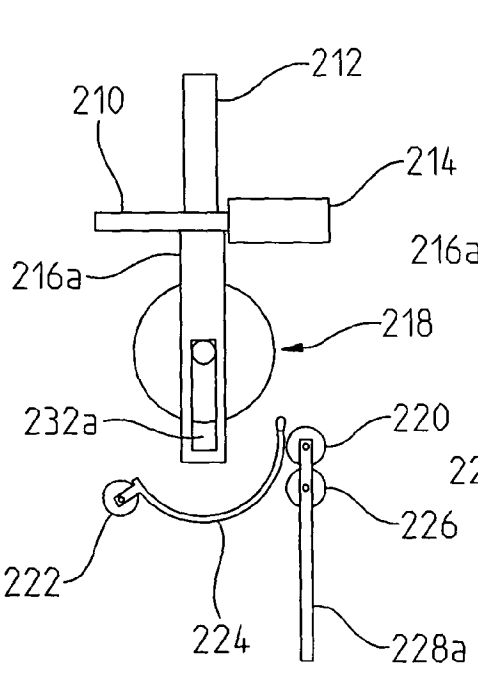

FIG. 8*a* is a side schematic view of the pull tab ticket revealer in its starting position;

FIG. 8*b* is a schematic view of the pull-tab ticket revealer with vertical solenoid 212 engaged;

FIG. 8*c* is a side schematic view of the pull-tab ticket revealer showing the effect of the drive gear 220 having rotated clockwise, thereby causing the ticket roller 218 and ticket seat 224 to rotate counter clockwise;

FIG. 8*d* is a side schematic view of the pull-tab revealer with horizontal solenoid 214 engaged;

FIG. 8*e* is a top plan view of a pull tab type ticket of the type useable with the present invention;

FIG. 8*f* is a perspective view of a pull tab type ticket of the type useable with the present invention;

FIG. 9 is identical to FIG. 8*a* and is provided for comparison purposes.

Figure 10:
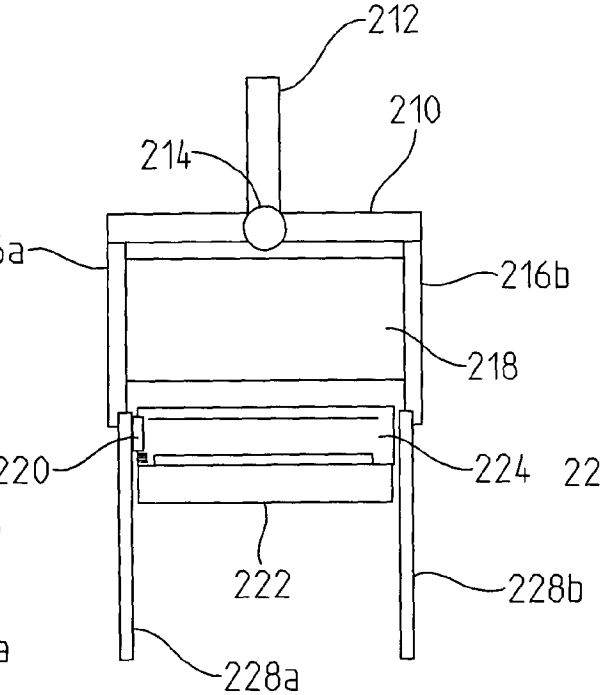

FIG. 10 is a front view of the pull-tab revealer embodiment, showing the revealer in the same position as shown in FIG. 8*a;*

Figure 11:
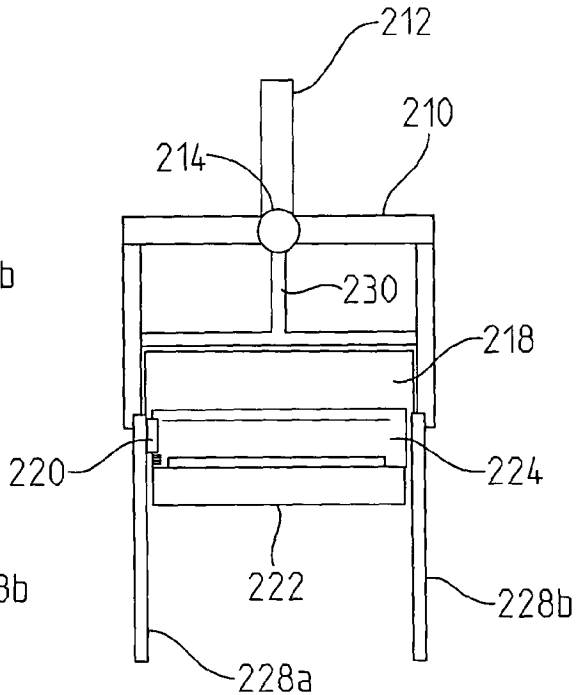

FIG. 11 is a front view of the pull tab revealer, similar to FIG. 10, but showing the revealer in the second step position, similar to FIG. 8*b;*

Figure 12:
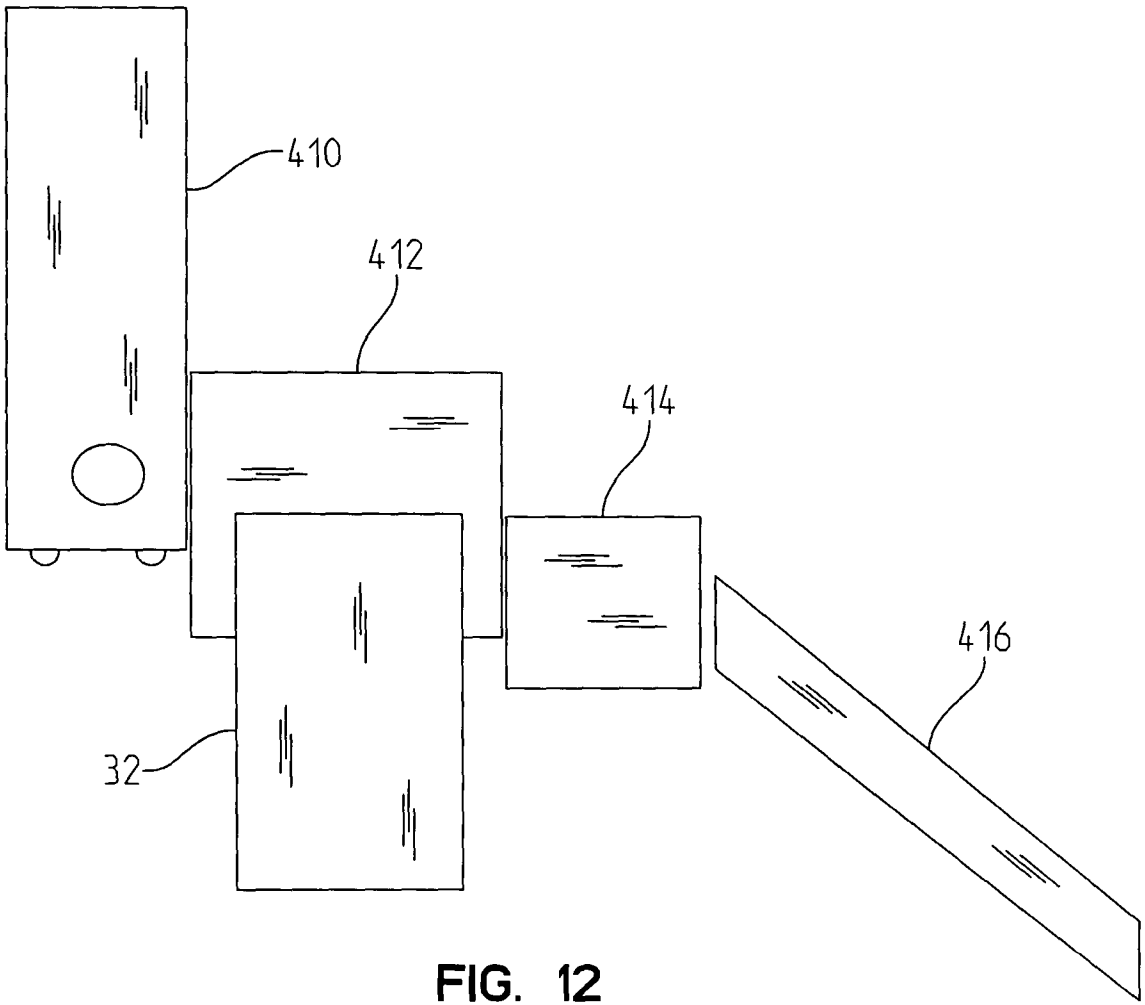
Figure 13:
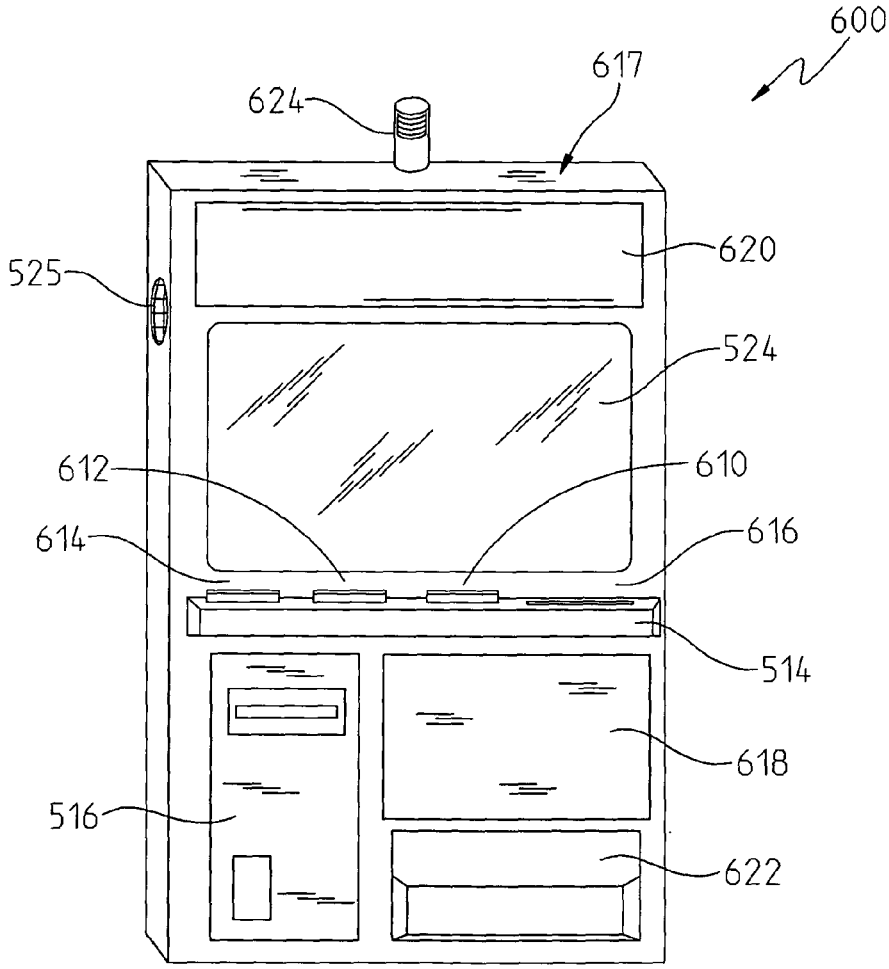
Figure 14:
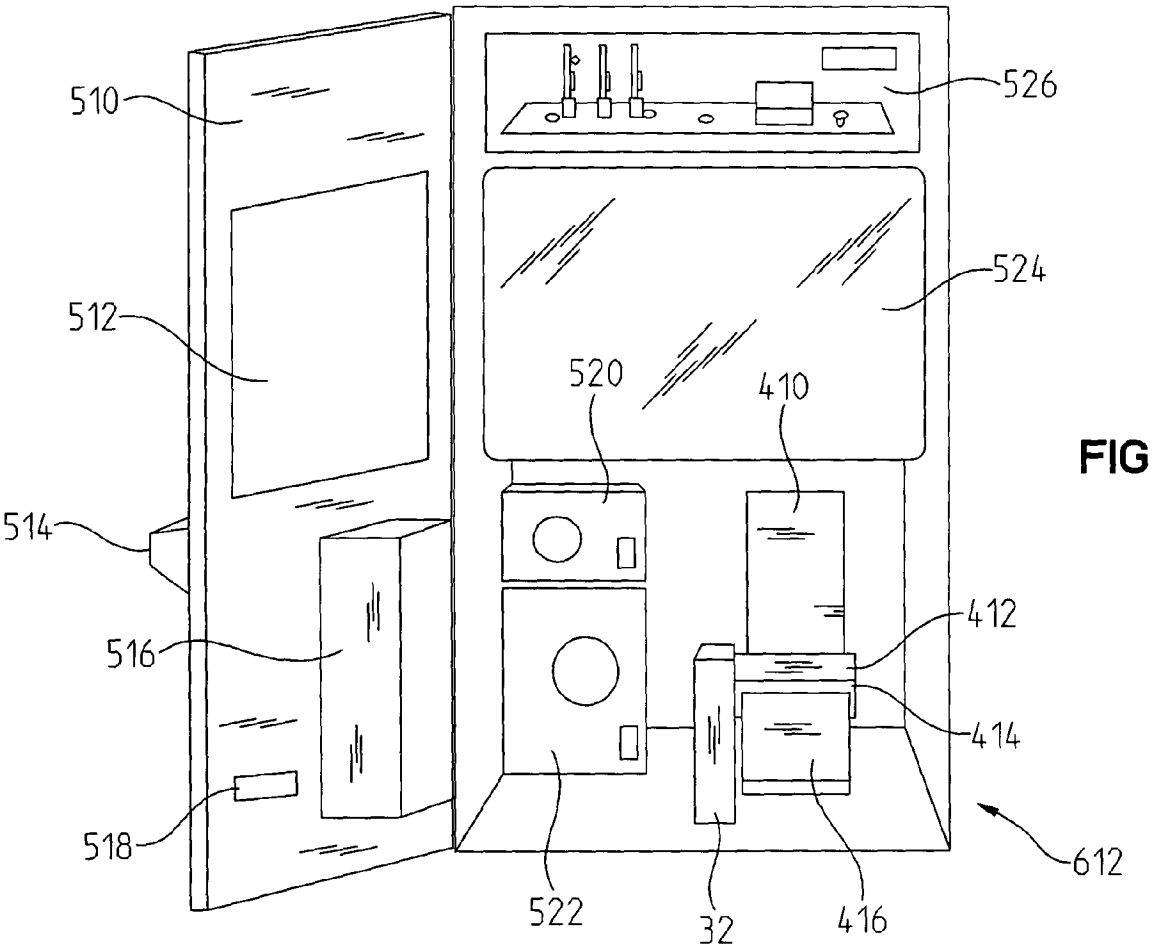
Figure 15:
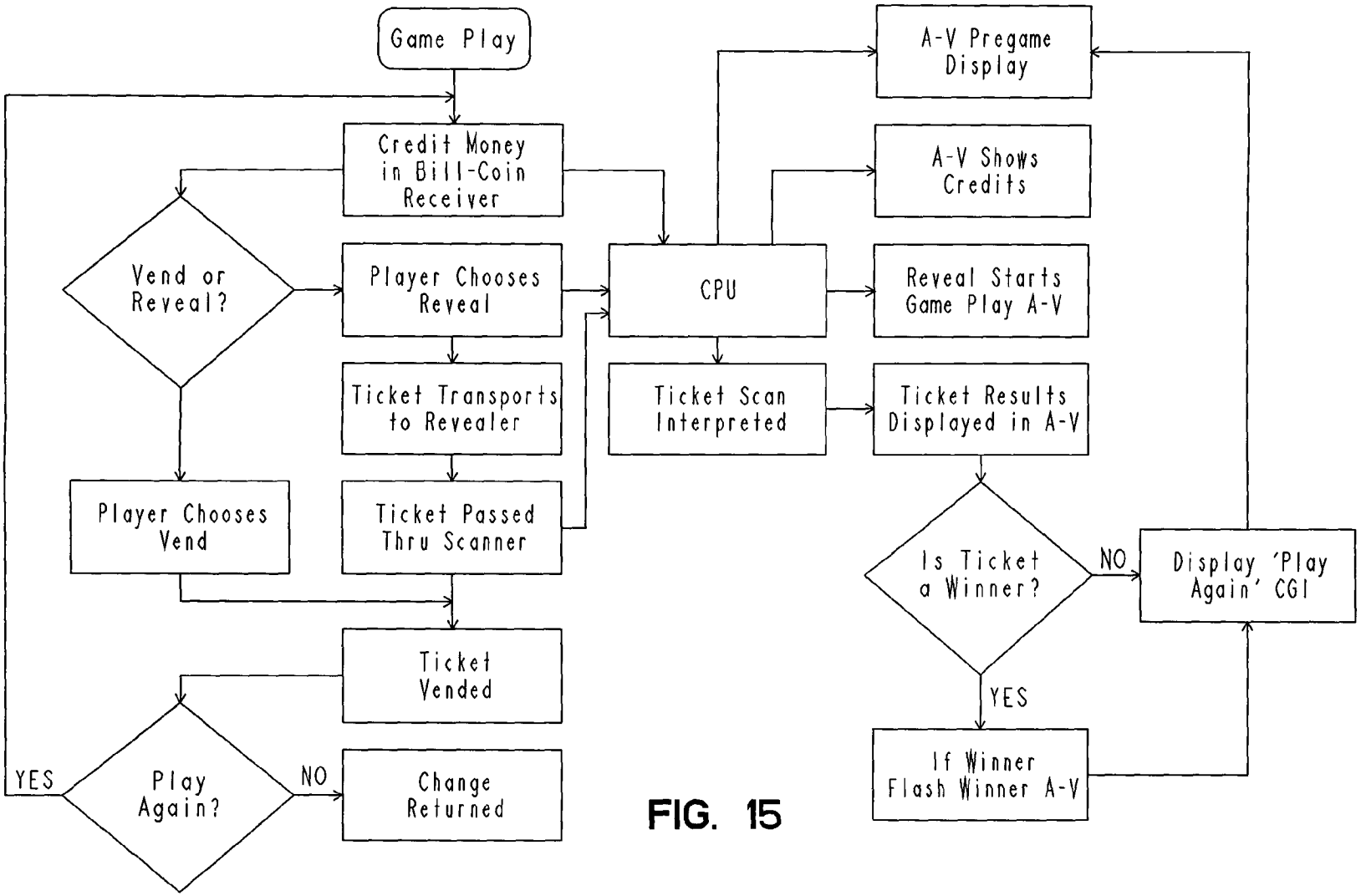

FIG. 12 is a schematic view of the assembled ticket processing mechanism;

FIG. 13 is a front view of the exterior of an assembled video gaming machine cabinet of the present invention;

FIG. 14 is a front view of the video gaming machine cabinet with its front access door open;

FIG. 15 is a flow chart for schematically illustrating the steps encountered in the basic game play computer program that controls the operation of the device; and

VI. DETAILED DESCRIPTION

A schematic representation that will serve as an overview for the gaming ticket dispensing device 300 of the present invention is best shown in FIG. 16. The gaming ticket dispensing device 300 is provided for dispensing gaming tickets, and in particular, for dispensing scratch off-type gaming tickets, such as scratch off tickets 304, 305 and pull tab-type gaming tickets, such as pull tab tickets 308, 310.

Actually, scratch off tickets 304, 305 represent the same ticket in two different states of being. Ticket 304 is shown in its pre-sale mode, wherein the ticket 304 includes a covering 306 that is preferably comprised of a waxy-type material. The covering 306 can be removed by scratching off the covering material with a hard object, such as the edge of a coin.

When the covering 306 is removed, prize revealing characters 307 become visible. The prize revealing characters 307 are disposed under the covering 306, and are normally not visible to the user prior to purchase by the user and scratching off by the user. Since the covering 306 is "scratched off" to remove the covering and thereby reveal the prize revealing characters 307, this type of ticket 304, 305 is commonly referred to as a scratch off ticket.

Although the prize revealing character 307 is shown as comprising a numeral ($5.00) that indicates the monetary value of the prize, it will also be appreciated that the prize revealing character could comprise a series of letters (e.g. no win) that designates that the revealed prize equals nothing. Alternately, the revealed character could comprise a word such as jewelry, to indicate that the user has won a non cash prize such as a jewelry. Further, these prize revealing tickets could reveal a code number such as "B" to alert the user to the fact that he had won prize B that could comprise whatever the game organizer designated prize B to be. Moreover, the prize revealing tickets could reveal a series of images such as dollar signs, fruit, coins, gems, playing cards, dice, or other symbols to alert the user that the prize has or has not been won.

Pull tab tickets 308, 310 are similarly represented, as they show essentially the same ticket in two different states. Pull tab ticket 308 is shown as comprising a substrate 312, that includes a removable material sheet covering 470 that is attached to the substrate 312 by perforations. In order to reveal the prize revealing characters 318, one uses the perforations to help separate the removable, material sheet covering 470. As the removable, material sheet covering 470 is pulled off the substrate 312, this type of ticket 308, 310 is commonly referred to as a "pull tab" ticket.

As will be described in more detail below, both the scratch off ticket and pull tab ticket bear similarities, insofar as both include prize revealing characters 307, 318 that are covered by a covering material. However, due to difference in nature between the waxy-like scratch removable covering 306 of the scratch off ticket 304, when compared to the material sheet covering 470 of pull tab 308, different mechanisms must be employed to remove the respective coverings 306, 470, to reveal the prize revealing characters 307, 318 respectively. The revealers 334, 336 that are employed to remove the respective different coverings 307, 470 respectively will be discussed in more detail below.

The game ticket dispensing device 300 includes a housing 322, that contains most of the primary components of the device 300. As described above, the housing 322 can take a variety of different sizes and shapes. For example, some might prefer to design the housing 322 to have the general size and shape of a slot machine. By giving the housing 322 a slot machine-type size and shape, the gaming ticket vendor will help to draw an association in the mind of the user between the gaming ticket dispenser 300, and a casino gaming machine. As the present device 300 is intended to provide the user with the thrill, excitement and live action aspects of a gaming machine, this association between the device 300 and the slot machine will help to subtly inform the user of the function of the gaming device 300, and may help to persuade the user to play the gaming device 300, especially in the case of users who were previously unfamiliar with the gaming device 300.

Alternately, the gaming device 300 can have a very large size, so that the gaming device housing 300 takes on the size and volume characteristics of a full-size vending machine, such as a full-size candy vending machine. It will be appreciated that such full-size vending machines are often the size of full-sized soft drink machines or full-sized side-by-side refrigerators.

The value of using such a large housing is both to make the device less easy to steal or move, and also to enable the device to carry a very large inventory of tickets. By carrying a large inventory of tickets, the length of time between necessary "refills" for the device 300 can be extended. This extension of time between refills can help reduce the labor costs associated with operating the device 300, and thereby make the device 300 more profitable. Alternately, some situations (e.g. taverns) exist wherein the preferred device will comprise a small device types that might be the size of (for example) a microwave oven or dorm-type compact refrigerator. A small sized device having these dimensions would be especially adaptable for use on a table top or on a bar counter. The device may also be mounted into a table-top or counter configuration, to allow it to resemble a casino table game, and to be incorporated into a bar for convenience and space saving.

The gaming ticket dispensing device 300 also includes a plurality of storage mechanisms for storing tickets. The gaming device includes four storage mechanisms, including a first storage mechanism, a second storage mechanism, a third storage mechanism and a fourth storage mechanism. The four storage mechanisms are illustrative, and are intended to show the various features of the device. It will be appreciated that different numbers and combinations of storage mechanisms can be used.

The first storage mechanism is shown as having a spindle, on which a roll of tickets can be placed. The roll of tickets are shown as being scratch off tickets that are formed on a roll, with adjacent tickets being separated by a perforation line. When using the storage mechanism such as storage mechanism that employs a roll of tickets separated by perforations, it will be appreciated that the storage mechanism (or some other component of the device) should include some sort of cutting or punching mechanism so that pressure can be applied to the perforated line to separate the tickets.

The second storage mechanism is a mechanism designed to accommodate a stack of scratch off tickets. The storage mechanism would be similar in theory, to the paper tray-type storage device that one might find used on a printer. When a storage device that is used for holding a stack of tickets is employed, the storage mechanism should include a picker mechanism that is capable of selectively removing one ticket at a time from the stack of tickets. As with a printer, this "picker" can comprise a tray and roller set that are configured so as to permit one ticket at a time to be removed from the storage mechanism, while enabling the remainder of the tickets in the storage mechanism to stay put within the storage mechanism.

The third storage mechanism is designed to hold a roll of pull tab-type tickets, such as pull tab ticket. Storage mechanism is generally similar to the first storage mechanism, insofar as it includes a spindle for supporting a roll of tickets. Fourth storage mechanism is generally similar to second storage mechanism insofar as it is designed for holding a stack of tickets. However, the fourth storage mechanism is shown as being designed for holding a stack of pull tab-type tickets such as pull tab tickets.

As will be described in more detail below, the differences between the coverings of scratch off-type tickets, versus pull tab-type tickets require that the tickets be handled differently by the revealer that removes the covering. As such, the pull off scratch-type tickets from the first and second storage mechanisms are directed to a first revealer that is designed for removing scratch off coverings. By contrast, the pull tab tickets that are contained on the third and fourth storage mechanisms are routed to a second revealer that is designed for removing the coverings from pull tab-type gaming tickets.

The first and second revealers are provided for removing the coverings from the pull tabs, to reveal the prize revealing characters. Also discussed above, the revealers operate differently, since the coverings of the scratch off and pull tab tickets respectively, are different and must be handled differently.

The operation of the revealers will be discussed in more detail below. However, from an overview perspective, it should be understood that revealer one is designed to use an abrader to abrade off the waxy covering that covers the prize revealing characters of the scratch off ticket. Second revealer removes the covering material sheet of a pull tab-type ticket by helping to physically pull off the material covering, to thereby separate the material covering from the substrate portion of the ticket.

After the pre-sold, unrevealed tickets pass through the revealers, respectively, the tickets appear similar to tickets 305 and 310 respectively. In particular, the covering 307 is removed from the ticket so that the prize revealing character 307 is removed from the scratch off ticket. Similarly, on the pull tab ticket 308, the material covering sheet 470 is removed from the substrate 312 to reveal the prize revealing character 318.

After the prize revealing characters 307, 316 are revealed, the ticket is transported to scanner. Scanner is preferably an optical scanner that scans information on the ticket. The primary information scanned by scanner is the prize revealing character of the tickets. This information relating to the prize revealing characters 307, 318 is then transmitted to processor.

The processor includes software of the type that can read the scanned prize revealing characters 307, 316. The processor can then read the scanned information to determine the amount of the prize (if any) awarded by the ticket. The processor 342 can comprise a specially built unit designed to operate the device 300, or else can comprise an off-the-shelf computer that is specially programmed to operate the device 300.

In addition to scanning the prize revealing characters 307, 318, the scanner can be designed to scan other information. For example, it may be designed to scan a bar code on the ticket, so that the processor will know the type of ticket that it is scanning. Additionally, authenticity information can be placed on the ticket that can be scanned, so that the processor will know that the ticket that is passing through the scanner is, in fact, an authentic ticket, and not a boot-leg ticket.

Several communication lines exist between the various components of the invention. These communication lines can be wires, wireless transmitters or other means of transmitting information between the various components.

After the device scans the ticket, the ticket is then transported to the dispenser. The dispenser will include a dispensing port that enables the user to remove the ticket from the machine. Although a wide variety of dispensing ports can be used, a dispensing port such as the ticket dispensing port in a parking lot ticket dispenser can be employed. Alternately, a hopper, into which the ticket falls, similar to the hopper at the bottom of a traditional vending machine can also be employed.

The device 300 also includes a transport mechanism such as a transporter. The transporter is provided for transporting the ticket from the storage means, to the revealer. The transport mechanism (transporter) also transports the ticket from the revealer to the scanner and ultimately to the dispenser, and its dispensing port.

The device 300 also includes an audio emission device that preferably comprises a loud speaker; and a visual display device that preferably comprises a CRT or LCD or plasma-type display that is similar to the type of display one would find in a computer screen or TV.

The purpose of the audio emission device and visual display is to display an audio visual message that is displayed in response to a stimulus by the processor. The audio visual display can be sounds and a computer graphic display that mimics the computer graphic display and sounds that one normally associates with a slot machine, video poker, video blackjack, video craps, video roulette, or other casino video gaming device. Such a display would be useful because it would give the machine casino game like "feel" that would likely be attractive to users. Additionally, the audio visual display can include a display that performs in an "attract" mode where sounds and computer graphics are displayed that are designed to attract the user to the machine. Such displays can include information about the machine, the manner in which it is played and the prizes that are available from playing the machine.

The device 300 also includes a user control. The user control can comprise a plurality of buttons that the user can push, dial or twist to achieve a desired result relating to the operation of the machine. For example, user controls can exist that would enable the user to select between which of the various types of tickets that the user wishes to purchase. In the exemplary machine 300, the device is shown to have the potential to contain four different types of tickets, with one type being stored in each of the various storage mechanisms. The user can move the user control to select which one of the four types of tickets he desires to purchase.

A second function of the user control is to control the particular manner in which the device operates. Preferably, the device is operable in both a "gaming mode" and a "silent mode". In a "silent mode" the device operates similar to any other gaming ticket dispenser. In particular, the user places his money in, selects his tickets, and his tickets are dispensed from the machine. In the "silent" or "unrevealed" mode, the tickets dispensed from the machine are not operated on by the revealer. Hence, the tickets wind up being dispensed with their coverings intact. The user can then scratch off the tickets himself. In an alternate or "gaming" mode, the user can select to have the tickets pass through the revealers such that the revealers uncover the coverings from the tickets 304, 308 respectively so that the tickets can then be passed onto the scanner that can scan the ticket. Once scanned, the scanner can forward the information to the processor, that can then send a signal to the visual display and audio display to make sounds and sights appropriate for the particular value scanned of the ticket, based upon the prize revealing characters 307, 318. For example, if the user has won $10.00, a computer visual display can flash an indicia such as "WINNER", while the audio display mimics a slot machine by producing a sound of a bell ringing or the like.

Although the tickets are dispensed, no visual or audio display is necessarily displayed. Alternately, simply a visual display can be displayed that displays the user's credit, or the prize value.

A funds handler is provided. The funds handler is operatively coupled to the processor, and to the visual display. The funds handler serves a variety of purposes. A first purpose is to accept funds into the machine. Depending upon user or machine owner preference, the funds handler can be designed to accept cash, tokens, and/or credit cards. Preferably, the funds handler also includes a display, so that the total amount of funds available on the machine are displayed. If desired, the total amount of money available for play can be the subject of an audio playback, thereby making the device more acceptable for use by sight-impaired persons.

It is believed that many people who use the machine will wish to make multiple "plays" with the machine. As such, even though a particular ticket may only cost $1.00, it is likely that a large number of people will wish to deposit a larger amount (e.g. $10.00) in the funds handler, so that they may have multiple plays. The funds handler can either have its own display, or cooperate with visual display through processor, to keep a running total of the amount of funds available to the user.

The funds handler should be designed not only to accept funds, but also to dispense change to the user. The user control preferably includes a control that enables the user to make a decision as to whether to "play again" or "cash out". For example, a user may deposit initially $10.00 into the funds handler. He may then decide to play five $1.00 tickets. After the five tickets are played, he may have, for example, lost on the first four tickets, but won $3.00 on the last ticket, which thus would leave the user with a net balance of $8.00. At this point, the user could then actuate the user control to play another ticket, or alternately, could employ the user control to tell the machine 300 to allow the user to "cash out". Upon receiving the cash out signal, the funds handler 362 would dispense $8.00 change (in this case) back to the user where this is allowed by law and the state lottery commission. Alternately, the device could issue a $5.00 credit and the user could take his winning ticket to be redeemed and converted into cash by a cashier.

A power supply is provided for providing power at a proper voltage and amperage to the various components within the device 300.

Two variations of a preferred embodiment of the machine are illustrated in FIGS. 1 through 15. The video gaming machine 300 can be configured to utilize scratch-off lottery tickets via the mechanism described in FIGS. 1 to 4. The video gaming machine 300 (e.g. 304) can alternately be configured to utilize pull-tab lottery tickets (e.g. 408) through the mechanism described in FIGS. 5 to 11. FIGS. 12 through 15 show the assembled machine using either the scratch off ticket revealer 334 or the pull-tab ticket revealer 336.

Figure 1:
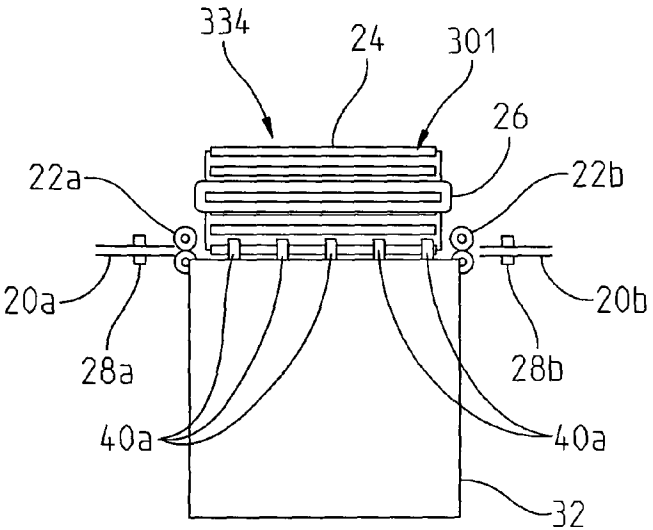
FIG. 1 is a first side view of a scratch off ticket revealer of the present invention.

FIG. 1 shows the scratch off ticket revealer 334 from the side. Revealer 334 includes an abrasion belt 24. An end view of the abrasion best 24 is shown in FIG. 1. Anterior 20*a* and posterior 20*b* ticket guide ways are disposed on each side of the abrasion belt 24. Adjustable guide fences 28*a* and 28*b* keep the ticket firmly in its appropriate lateral position. Part 40*a* comprises fixed fence guides that are attached to the side of pressure plate part 40 (visible in FIG. 4). Anterior 22*a* and posterior 22*b* pinch rollers propel the ticket 10 under the abrasion belt 24, and are approximately 10 to 13 centimeters in width. The drive for pinch rollers 22*a* and 22*b* is not shown. The pressure plate port 40 is disposed on a side of the ticket 304 opposite the prize revealing character 307 and covering 306 containing front side surface 313 (FIG. 16) of the ticket 304.

Abrasion belt 24 preferably comprises of a flexible cylindrical belt manufactured from reinforced rubber, or similar flexible material, and is approximately 5 to 10 centimeters in width, and of sufficient diameter to extend across the front of the scratch off ticket 304. For tickets 304 that are sized similarly to most common size of ticket sold, a diameter of 25 millimeters for the abrasion belt 24 should be sufficient. Abrasion belt 24 has ribs 301 that extend across its width perpendicular to the direction of travel of the belt 24. The ribs 301 are preferably made of metal or hardened plastic. The ribs 301 are evenly spaced several millimeters apart, two to three millimeters in height, and have an angular edge 303 perpendicular to pressure plate 40 to facilitate removal of the waxy covering from lottery tickets.

The abrasion belt rotates about rollers 36*a*, 36*b* so that the underside of the belt which is in contact with the ticket 304 travels toward refuse bin 32 to thereby push the removed waxy covering into the refuse bin 32. A fixed or moving brush 26 removes the waxy refuse from the abrasion belt 24 into refuse bin 32 below it. Refuse bin 32 is removable for cleaning when the machine 300 is restocked with tickets.

An upstream guide way 20*a* is disposed upstream in the ticket path from abrasion belt 24, and a down stream guide way 20*b* is disposed downstream in the ticket path from abrasion belt 24. Each of the guide ways 20*a*, 20*b* comprises a pair of opposed plates disposed in parallel planes, and spaced apart by a few millimeters. The space between the parallel plates of each guide way 20*a*, 20*b* defines a slot-like portion of the ticket travel path which respectively guides the ticket to the abrasion belt 24 (guide way 20) and away from the abrasion belt (guide way 20*b*) such that pressure plate 20*a* is disposed above the ticket 304, and adjacent to the covering 306 containing face 313 of the ticket. Pressure plate 20*b* is disposed below the ticket 304, and adjacent to the underneath surface of the ticket 304. The plates of guide ways 20*a*, 20*b* are preferably manufactured of metal or any smooth hardened material.

Adjustable fences 28*a* and 28*b* are an optional feature, consisting of rounded studs of metal or similar hardened material. Adjustable fences 28*a* and 28*b* may be slid along guide slots 34*a* and 34*b*, respectively, to adjust to the proper ticket width to maintain the proper lateral positioning of the tickets. Once properly adjusted, the adjustable fences are secured in position with a nut or similar fastener. Adjustably positionable fences 28*a* 28*b* could be replaced by fixedly positioned fences.

Figure 2:
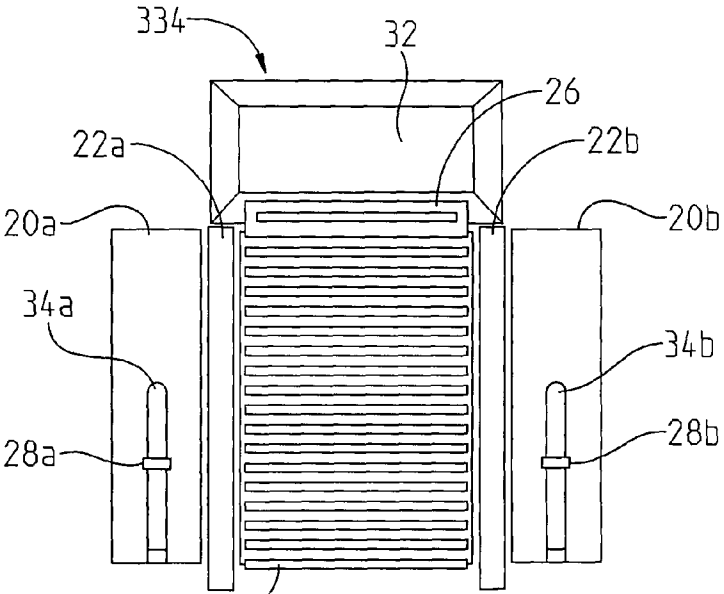
FIG. 2 is a top view of the scratch off ticket revealer.

FIG. 2 shows an overhead (top) view of the scratch off ticket revealer 334. In FIG. 2, guide slots 34*a* and 34*b* for adjustable fences 28*a* and 28*b* are shown, along with the ticket path in which the lottery ticket 304 will travel through the ticket revealer 334. Revealer 334 can be configured to work with either a ticker roll dispenser (such as is shown at 324 of FIG. 16) or a ticket stack dispenser as is shown in storage mechanism 236. The ticket roll dispenser 324 or ticket stack dispenser 326 will feed the scratch off ticket into upstream guide way between plates 20*a*. The scratch off ticket 304 passes through guide way into a drive roller, such as pinch roller set 22*a*, which propels the ticket between the rotating abrasion belt 24 and pressure plate 40. As the scratch off ticket advances between the abrasion belt 24 and the pressure plate 40, it is secured against lateral movement by adjustable fences 28*a* and 28*b* and fixed fence 40*a*.

Abrasion belt 24 abrades the covering 306 of the ticket to thereby scratch off the waxy material (which comprises the covering material 306), and which obscures the ticket play area. The waxy debris removed from the ticket 304 through the abrading by abrasion belt 24 is brushed off the abrasion belt ribs 301 by brush 26 and drops into removable collection bin 32. Having passed between abrasion belt 24 and pressure plate 40, the scratch off ticket 301 is engaged by pinch roller set 22*b* which propels the ticket through guide way ticket 20*b*. The ticket passes through guide way 20*b* and into scanner 414 (shown in FIG. 12) (or scanner 340 of FIG. 16). Scanner 414 is preferably an optical scanner, many models of which are commercially available. However, a wide variety of other scanning devices exist that are capable of translating printed figures to digital data and may work in the present invention.

Figure 3:
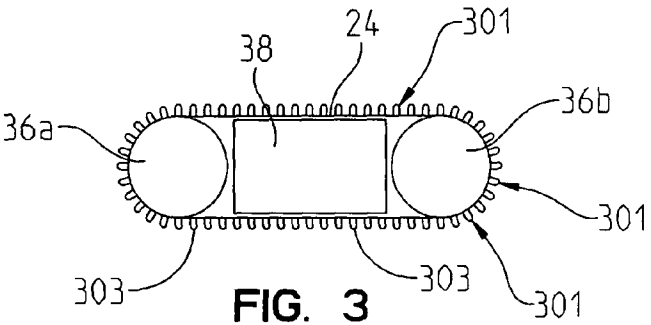
FIG. 3 is a front view of an abrasion belt 24 of the revealer of the present invention.

FIG. 3 shows the abrasion belt 24 from a front side view. Drive rollers 36*a* and 36*b* rotate abrasion belt 24. Interior pressure plate 38 serves as a tensioner for maintaining firm and even contact between the ticket surface 313 and abrasion belt 24.

Figure 4:
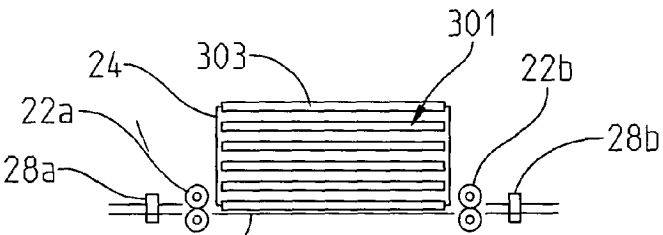
FIG. 4 is a second side view of the scratch off ticket revealer, the second side being the side opposite the first side of shown in FIG. 1.

FIG. 4 shows the scratch off ticket revealer 12 from the opposite side of FIG. 1. From this angle, pressure plate 40 is visible. Pressure plate 40 is placed adjacent the bottom surface of the ticket 304 and supports the ticket 301 from the bottom as the abrasion belt 24 moves across the top surface 313 abrading off the covering 306. Other parts previously seen in FIGS. 1 through 3 are present in FIG. 4 except refuse bin 32, fixed fence 40*a*, and brush 26, that are obscured from view as they are disposed at the opposite end of the scratch off ticket revealer 12.

Figure 5:
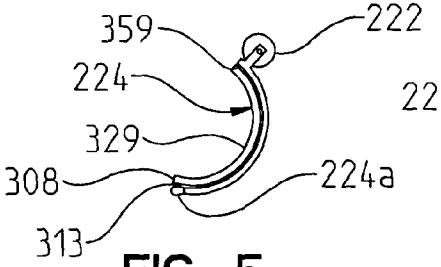
FIG. 5 is a side view of a ticket seat of an alternate embodiment revealer particularly well suited for pull tabs.

FIGS. 5 through 8*d* show an alternate embodiment ticket revealer assembly 336. The embodiment shown in FIGS. 5-8*d* is an alternative to the scratch off ticket revealer 334 presented in FIGS. 1-4, and is particularly well suited to allow the mechanism to employ pull-tab style lottery tickets such as ticket 308. The revealer includes a revealer assembly 201 that includes a burster roller sub-assembly 205, a ticket seat member 224, and a covering sheet puller sub-assembly 203. FIG. 5 shows the ticket seat 224 from its lateral edge.

As shown in FIG. 5, a pull tab-type ticket 308 is picked from either a roll 328 or stack 330 of tickets, by a picker, which is part of transporter 356, and is moved by the transporter 356 to the underside surface 359 of the ticket seat 324. The ticket is placed on the seat 324 such that is top or face surface 313 is placed against the underside surface 359 of the ticket seat 324, and the underside surface 329 of the ticket 308 faces the surface of burster roller 218, so that the underside surface 329 can engage the burster roller 218. Although the burster roller 218 is shown as having a cylindrical roll shape, the burster could also be hemi-cylindrical, or have some other shape that would permit the ticket to be bent backward upon it.

Figure 7:
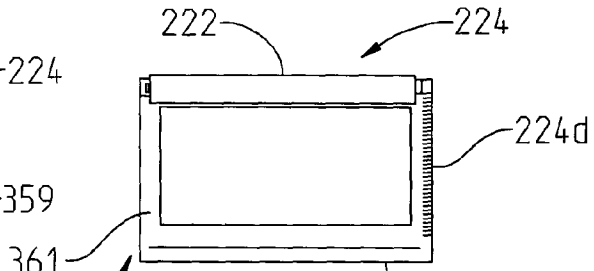
FIG. 7 is a top view of the ticket seat of FIG. 5 showing its bottom convex side.

The ticket seat 224 is preferably made of smooth metal or similar hardened substance. A stop ridge 224*a* runs across the posterior edge of the ticket seat 224 and extends upwardly on the outwardly facing surface 361 of the seat 224 (FIG. 7). Passive (non-driving) pinch roller 222 is generally cylindrical in configuration and is rotatably mounted to the upper side surface 361 to extend across the majority of the width of the upperside surface 361 of the ticket seat 224. The pinch roller 222 is mounted to the anterior end, secured at either end by small support brackets 202, 204 to ticket seat 224. Passive pinch roller 222 is preferably manufactured of rubber, neoprene, or any similar semi-hard substance having a surface with a sufficiently great co-efficient of friction to provide friction to grip the pull tabs for removal.

Figure 6:
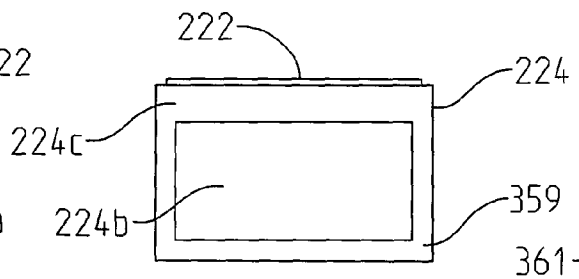
FIG. 6 is a top view of the ticket seat of FIG. 5 showing its concave side.

FIG. 6 shows the ticket seat from its underside 359, which is curved to match the curvature of burster roller 218. Seat 224*a* includes a rectangular opening 224*b* through which individual bursted pull tabs 470 extend. 224*c* is the recessed edge of the ticket seat opposite the passive ticket roller 222. This recessed edge 224*c* allows the pull tabs 470 to be removed cleanly from the non-perforated edge connected to the primary substrate 312 of ticket 308. FIG. 7 shows the ticket seat part 224 from the upper, convex side 361. Stop ridge 224*a* and passive roller 222 are visible. Additionally, the toothed edge 224*d* of the ticket seat 224 is shown. The teeth of the toothed edge 224*d* mesh with the teeth on roller to 220 to facilitate rotation of ticket seat 224. Alternately, ticket seat 224 could be manufactured with teeth at the opposite end or both ends. Alternately ticket seat 224 could be rotated by use of a direct drive or solenoid. Alternately ticket seat 224 could be passive and rotated by engaging with burster roller 218, which would in such configuration be connected to a rotational drive mechanism.

FIGS. 8*e* and 8*f* show the configuration of commonly sold pull tab ticket 308. The tickets consist of two sheets of heavy card stock adhered together so that three or more pull tabs 470, may be removed to reveal the ticket play characters. The tickets 308 include a substrate portion 312, including a surface on which the prize revealing characters 316 (FIG. 16) are contained. Pull tabs 470 are cut from one of the card stock sheets with perforations on three edges. The three sided perforations define the covering member 470 which is also referred to as the pull tab portion 470. The covering portion 470 is the portion that is removed by the revealer assembly 201 to thereby reveal the prize revealing characters 316. By applying concave pressure to the ticket opposite the pull tab side, the pull tabs burst from their perforations, revealing the play characters. The pull tabs 470 ordinarily remain connected to the ticket by the remaining non-perforated edge. This "concave pressure" is exerted by using the ticket seat 324 to cause the underside 329 of the ticket 308 to engage the cylindrical surface of burster roller 218. See FIGS. 5-8*d*.

FIGS. 8*a* through 8*d* show the pull-tab ticket revealer assembly through the four stages of its function. All parts here are manufactured of hardened metal or similar substance with the exception of rollers 218, 222, and 226.

Revealer assembly 201 includes the burster roller assembly 205, ticket seat 224, and pull tab assembly 203. The burster roller assembly includes a horizontal guide 210, a horizontal mover such as solenoid 214, a vertical guide 216 and a vertical mover such as vertical solenoid 212. The vertical guide 210 includes vertical guide slots 230, 232*a* and cylindrical burster roller 218 that includes a cylindrical ticket engaging surface 219.

Horizontal guide bracket 210 allows lateral (horizontal) movement of the ticket remover burster roller assembly 205 at a consistent vertical position. Horizontal solenoid 214 moves the burster roller assembly 205 in both directions along horizontal guide bracket 210. Vertical guide brackets 216*a*, 216*b* guide, direct, and limit the vertical movement of burster roller 218. Vertical solenoid 212 moves the ticket burster roller 218 along vertical guide brackets 216*a* and 216*b* in both an up and down direction. Guide slots 232*a* and 232*b* are formed in vertical brackets 216*a* and 216*b*. Ticket burster roller 218 is preferably any metal, hardened rubber, durable plastic or similar hard substance which provides friction to frictionally engage and maintain the ticket to hold ticket 308 in place against ticket seat 224.

A drive roller, such as active pinch roller 226 is rotated by a belt drive, gear drive, or direct drive (drive not shown here). Drive gear 220 engages the teeth 224*d* of ticket seat 224 to rotate ticket seat 224 into position so that passive pinch roller 222 engages firmly with active pinch roller 226, to facilitate the gripping and tearing off the pull tab 308. Drive gear 220 is preferably driven by a belt, transmission, or direct drive (not shown). As discussed, other methods of rotating burster roller 218 and ticket seat 224 may be substituted. Like passive pinch roller 222, active pinch roller 226 is preferably manufactured of rubber, neoprene, or any similar semi-hard substance which provides friction to grip the pull tabs for removal. Structural bracket 228 holds roller 220 and roller 226 in place on the axles which rotatably mount the rollers 220, 226 onto bracket 228*a*.

FIG. 8*a* shows the pull tabs ticket revealer 336 in starting position. A pull tab ticket 308 is deposited so that its face 313 engages ticket seat 224, and so that tab 470 is disposed over opening 224*b* on ticket seat 224 from a ticket roll. In FIG. 8*b* vertical solenoid 212 engages to vertically move burster roller 218 downwardly along vertical guide brackets 216*a* and 216*b*, so that the burster roller 218 engages the pull tab ticket 308. The engagement of ticket 308 with the burster roller 218 causes the ticket 308 to flex, and to conform to the curvature of ticket seat 224. The concave pressure causes the pull tabs 470 to burst from their perforations.

The pull tabs extend down through opening 224*b* between pinch rollers 222 and 226. In Fig., the drive gear 220 rotates clockwise causing the ticket roller 218 and seat 224 to rotate counter clockwise, which engages passive pinch roller 222 and active pinch roller 226, pulling the pull tabs from the non-perforated edge connected to the ticket. The pull tabs 470 are then dropped into a chute leading to a removable refuse bin (not shown). The ticket's prize revealing characters 316 are now revealed.

In FIG. 8*d*, horizontal solenoid 214 is shown as laterally moving the ticket roller 218 horizontally along guide bracket 210 away from ticket seat 224. This separation permits the ticket 308 to drop via gravity into the chute leading to the scanner (414 in FIG. 12). As in the scratch off revealer 304, the scanner 314 is preferably any of several commercially available optical scanners. Alternately, the same scanner 340 can be used for both pull tab and scratch off tickets. The process complete, the pull tab ticket revealer mechanism returns to its start position as shown in FIG. 8*a*.

FIG. 10 shows the pull tab revealer from the front side and corresponds to FIG. 8*a* in the reveal process that is the "start" position. FIG. 10 shows vertical bracket 216*b*. Guide slot 232*b* (not shown) is situated in vertical bracket 216*b* the same way that guide slot 232*a* is situated in vertical bracket 216*a*.

FIG. 11 shows the front side of the pull tab revealer at the second step of the reveal process seen in FIG. 8*b*. In this view vertical solenoid 212 has engaged, propelling the ticket roller 218 downward into engagement with ticket seat 224. This view better shows bracket and axle assembly 230, which connects ticket burster roller 218 to vertical solenoid 212, creating movement of burster roller 218 along vertical bracket 216*a* and 216*b*.

FIG. 12 shows a schematic view of the assembled ticket processing mechanism. The ticket moves from the dispenser 410 into ticket revealer 412 (either the scratch off ticket revealer described in FIGS. 1 through 4, or the pull tab ticket revealer described in FIGS. 5 through 11). The covering 306 or 470 is then removed from the ticket in the revealer 412. Once the covering 306 or 470 is removed, the revealed ticket is then transported by transporter 356 to optical scanner 414. As described, the scanner 414 is preferably identical to any of several optical scanners readily available on the market. The ticket passes through the scanner 414 where it is optically scanned and then and to the final dispenser chute 416. Ticket is transported by gravity through chute 416 out of the machine into a bin for retrieval by the customer. Alternately, pinch rollers can be employed to move the ticket to the dispensing port, in much the same way that a series of rollers are employed to move a sheet of paper through a paper path in a printer.

FIG. 13 shows the exterior of the assembled video gaming machine cabinet 600. It is structured much like a casino style video slot machine, having a top end 600, a bottom end 602, two sides 604, 606, front end 608, and back end 609. The machine has an alert candle 624 which flashes when the player wants to cash out or when the machine requires service.

The machine 600 has colorful lighted display panels 620 and 618 to create the simulation of a casino experience. The machine also has a video monitor 524 disposed on the front end 608 of the device 600. The monitor 524 is preferably positioned at or around an average user's eye level. One or more audio speakers 525 may be provided for providing an audio message that corresponds or compliments the video message being delivered by the video display screen 524.

A funds handler includes a bill and coin acceptor 516 that accepts a user's money and provides for coin return. A vending bin 622 is provided where the revealed or unrevealed tickets are dispensed to the vending bin 622.

Button mantle 514 contains a plurality of user-operable gaming control buttons 610, 612, and 614. Button 614 is the cash-out button. Button 614 lights candle 624 for calling an attendant to cash out the player's winning tickets. Button 612 is the "vend without play" button. Pressing this button vends an unrevealed lottery ticket to the user. Button 610 is the play button, which engages the reveal, scan, and display process previously described. These buttons may also be programmed to control other functions during game play, and additional game play buttons may be included on the mantle. Sign 616 displays player instructions. Sign 616 may be a simple unlit sign, backlit card, or a small liquid crystal display. Other buttons and controls may exist, depending upon the desires of the device manufacturer and/or ticket vendors.

FIG. 14 shows an embodiment of an open video gaming machine cabinet used to house the device 600. The housing includes an open front 510. A display monitor bezel and opening 512 sits just above a button mantle 514. The housing also includes a bill and change acceptor and change return 516 and a vend slot 518 to ticket bin 622 (seen in FIG. 13). Computer compartment 528, contains the motherboard, CPU, hard drives, memory, and expansion cards that together comprise the processor. This compartment may be secured by a separate locking door (not shown). The video monitor 524, is preferably a standard plasma, liquid crystal display, or cathode ray tube display. The power supply system includes a computer power supply 520 and a general power supply 522 for non-computer electronics. The assembled ticket processing mechanism detailed in FIG. 12 is seen next to power supplies 520 and 522.

FIG. 15 is a flow chart that illustrates the basic game play of the computer program that controls the operation of the device 600. The flow chart does not include accounting, security, maintenance, diagnostic, and update input subroutines which would be necessary. The left column of the flow chart demonstrates the physical activity of game play. That physical activity triggers the CPU in column 2, to display the audio/visual output represented in column 3. The flowchart is laid out so that events read left to right are roughly contemporaneous. The software design contemplates the need for occasional updates to accommodate changing scratch off games. These updates will primarily be to the optical recognition routine to allow the recognition of new characters. Minor updates may also be necessary in the game subroutine to accommodate wild characters, bonus play, and other variations. Updates may be accomplished via input from hard media, or from a secure Ethernet or wireless network. The machine requires periodic maintenance to replenish tickets, remove money, and empty the various refuse bins.

The machine operates much as a standard casino video gaming machine would operate. The player inserts money (or a credit card) into the funds acceptor, and is given a series of plays based on the amount of money inserted. The player initiates play by pressing a button or pulling a lever. If the player pushes the vend without play button, an unrevealed ticket is vended and the monitor displays a graphic on monitor 524 wishing the player luck. If the play button is pushed, the video monitor 524 on the machine 600 displays the game play with accompanying sound, simulating a slot machine, card game, roulette, dice, or similar game. Inside the machine 600, an instant lottery ticket is passed through the revealer, revealing the play characters on the ticket. The ticket then passes though the optical scanner, and vended. The ticket scan is processed by the computer for character recognition, the ticket results are determined, and are incorporated into the audiovisual display of the machine. The game is concluded by graphically displaying the ticket outcome, and a request to play again.

The machine can be alternately configured as a console, tabletop, or standup style video game or slot machine cabinet. The machine may also be incorporated into a wall, multi-terminal cluster, or a novel vending machine cabinet. A lever to allow "one arm bandit" style play may be incorporated. The design of the scratch off ticket revealer may be altered by changing the layout of the ribs on the abrasion belt, or by incorporating multiple abrasion belts.

Other scratch off revealer designs may be incorporated. Changes in the game audiovisual display may be utilized to simulate different types of games. The ticket reveal sequence may be altered so that tickets are revealed and scanned prior to initiation of play to allow faster play. Machine payout may be incorporated where legally allowed. The machine may be programmed to allow the player to select from a menu of different audiovisual games utilizing the same optical scan system.

A machine of the present invention could be utilized in any store in which standard lottery tickets are sold. The machine 600 would be especially attractive to horse racing tracks, off-track betting parlors or jurisdictions that have not approved of slot machines in such places. The machines would also allow any owner of a bar, pub, or recreational facility to add economical, legal casino type entertainment. This will increase the revenue of both the business featuring the machines, and the state government which sells the lottery tickets.

Although the description above contains many specifics, these should not be construed as limiting the scope of the invention. Rather, said description is offered as merely providing illustrations of the presently preferred embodiments of this invention. For example, the machine could be configured to allow the player to choose from a selection of different audiovisual game simulations.

Thus, the scope of the invention should be determined by the appended claims and their legal equivalents, and not just the examples given.

What is claimed is:

1. A gaming ticket dispensing device for dispensing tickets having prize revealing characters and a removable covering for hiding the prize revealing characters prior to acquisition by an end user, the ticket dispensing device comprising:

(a) a storage mechanism for holding a plurality of gaming tickets;

(b) a revealer for removing the removable covering to reveal the prize revealing characters;

(c) a scanner for scanning the prize revealing characters;

(d) a processor in communication with the scanner for processing information derived from the scanned prize revealing characters to determine a prize value associated with the characters scanned;

(e) an audiovisual display for displaying an audiovisual message relating to the prize value; and (f) a dispensing port for dispensing the game ticket to the user, wherein the revealer comprises a scratch off revealer capable of removing a scratch off type covering from a gaming ticket without destroying the prize revealing character beneath the scratch off type covering and wherein the revealer includes an abrasive belt for removing the scratch off type covering by abrading the scratch off type covering.

2. The gaming ticket dispensing device of claim 1 further comprising a transport mechanism for transporting the gaming ticket between the storage mechanism, the revealer, the scanner and the dispensing port.

3. The gaming device of claim 2 wherein the gaming tickets are held in the storage mechanism as a roll of joined gaming tickets, and wherein the transport mechanism includes a separator for separating individual gaming tickets from the roll of joined gaming tickets.

4. The gaming device of claim 3 wherein the transport mechanism includes first and second spaced guide members that define a ticket path through which the gaming ticket travels, the guide members serving to properly position gaming tickets passing along the ticket path.

5. The gaming device of claim 4 wherein at least one of the first and second guide members is adjustably positionable to accommodate gaming tickets of different sizes.

6. The gaming device of claim 5 wherein the transport mechanism further includes drive rollers capable of engaging gaming tickets moving through the ticket path for advancing the tickets along the ticket path.

7. The gaming device of claim 6 wherein the drive rollers comprise a pair of opposed pinch rollers sized and positioned to capture the gaming ticket between the pinch rollers to advance the gaming ticket along the ticket path.

8. The gaming device of claim 2 wherein the gaming tickets are held in the storage mechanism as a stack of tickets, and wherein the transport mechanism includes a picker for removing a single gaming ticket from the stack of gaming tickets, so that the gaming ticket can be advanced within the gaming device.

9. The gaming device of claim 1 wherein the scratch off revealer includes a pressure plate disposed on a side of the scratch off gaming ticket opposite to the abrasive belt, wherein the revealer traps the gaming ticket having its covering removed between the abrasive belt and the pressure plate, to enable the abrasive belt to exert force against the gaming ticket.

10. The gaming device of claim 9 wherein the gaming ticket moves through the revealer along the ticket path in a first direction, and the abrasive belt abrades the gaming ticket in a direction generally perpendicular to the first direction.

11. The gaming device of claim 10 wherein the revealer includes at least one drive roller for rotatably moving the abrasive belt, and a brush engageable with the abrasive belt for removing waste materials from the abrasive belt.

12. A gaming ticket dispensing device for dispensing gaming tickets having prize revealing characters and a removable covering for hiding the prize revealing characters prior to acquisition by an end user, the gaming ticket including a substrate portion having a character container surface for containing the prize revealing characters, the removable covering comprising a covering material sheet that covers the revealing characters and is capable of being peeled away from the substrate to uncover the prize revealing characters, the ticket dispensing device comprising:

(a) a storage mechanism for holding a plurality of gaming tickets;

(b) a revealer for removing the removable covering to reveal the prize revealing characters, the revealer including:

(1) a burster roller engagable with the gaming ticket for causing the covering material sheet to at least partially separate from the substrate, (2) a ticket seat capable of engaging the gaming ticket for pressing the ticket against the burster roller to foster the busting away of the covering material sheet from the substrate; and (3) a puller capable of engaging the covering material sheet and pulling the covering engaging sheet away from the substrate (c) a scanner for scanning the prize revealing characters;

(d) a processor in communication with the scanner for processing information derived from the scanned prize revealing characters to determine a prize value associated with the characters scanned;

(e) an audiovisual display for displaying an audiovisual message relating to the prize value; and (f) a dispensing port for dispensing the game ticket to the user wherein the ticket seat includes an opening positioned for permitting the covering material sheet to facilitate the capture of the covering material sheet by the puller, while causing the substrate portion of the gaming ticket to be captured between the ticket seat and the burster roller, and further comprising a drive roller for rotatably driving the puller for pulling the covering material sheet away from the substrate, whereby pulling of the covering material sheet causes movement of the ticket seat and rotary movement of the burster roller.

13. The gaming device of claim 1 where the processor is capable of sending a signal to the audio visual display to display a monetary value of the prize revealed by the prize revealing characters and to play an audio sequence that mimics a sound associated with casino gaming machines.

14. The gaming device of claim 1 further comprising a funds acceptor for accepting funds by the user, and determining credits purchased by the user based on the funds received.

15. The gaming device of claim 1 further comprising at least one user control button for permitting the user to control at least one operation parameter of the machine.

16. The gaming device of claim 15 wherein the at least one operation parameter of the machine is chosen from the group consisting of (a) whether to dispense the gaming ticket in a revealed mode where the prize revealing characters are revealed, or a concealed mode where the prize revealing characters remain concealed by the covering;

(b) which of a plurality of ticket typos are chosen for purchase;

(c) the quantity of tickets chosen for purchase;

(d) whether to continue play on existing credits or cash out accumulated credits; and (e) whether to dispense a cash pay out or a voucher pay out.

17. The gaming device of claim 1 wherein the storage mechanism comprises a plurality of storage stations, each of which storage stations is capable of holding a discreet supply of a plurality of tickets, wherein the processor includes software for controlling operational parameters of the game selected from the group consisting of funds handling, operation of the audio visual display, operation of the revealer, operation of the transporter and operation of the scanner and determination of type of gaming ticket being dispensed.

18. A gaming ticket dispensing device for dispensing gaming tickets having prize revealing characters and a removable covering for hiding the prize revealing characters prior to acquisition by an end user, the gaming ticket including a substrate portion having a character container surface for containing the prize revealing characters, the removable covering comprising a covering material sheet that covers the revealing characters and is capable of being peeled away from the substrate to uncover the prize revealing characters, the ticket dispensing device comprising:

(a) a storage mechanism for holding a plurality of gaming tickets;

(b) a revealer for removing the removable covering to reveal the prize revealing characters, the revealer including:

(1) a burster roller engagable with the gaming ticket for causing the covering material sheet to at least partially separate from the substrate, (2) a ticket seat capable of engaging the gaming ticket for pressing the ticket against the burster roller to foster the busting away of the covering material sheet from the substrate; and (3) a puller capable of engaging the covering material sheet and pulling the covering engaging sheet away from the substrate (c) a scanner for scanning the prize revealing characters;

(d) a processor in communication with the scanner for processing information derived from the scanned prize revealing characters to determine a prize value associated with the characters scanned;

(e) an audiovisual display for displaying an audiovisual message relating to the prize value; and (f) a dispensing port for dispensing the game ticket to the user wherein the ticket seat includes an opening positioned for permitting the covering material sheet to facilitate the capture of the covering material sheet by the puller, while causing the substrate portion of the gaming ticket to be captured between the ticket seat and the burster roller, and further comprising a drive roller for advancing the game ticket and additional pulling of the covering material sheet away from the substrate.

* * * * *